US006302351B1

(12) United States Patent
Omdoll et al.

(10) Patent No.: US 6,302,351 B1
(45) **Date of Patent: *Oct. 16, 2001**

(54) DISPENSER FOR MULTIPLE ROLLS OF SHEET MATERIAL

(75) Inventors: Paul A. Omdoll, Waukesha; Scott J. Collins, Brown Deer, both of WI (US)

(73) Assignee: The Colman Group, Inc., Elkhorn, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,640

(22) Filed: Feb. 25, 1999

Related U.S. Application Data

(60) Provisional application No. 60/076,289, filed on Feb. 27, 1998.

(51) Int. Cl.[7] ..... B65H 16/10

(52) U.S. Cl. ..... 242/564.5; 242/564.2

(58) Field of Search ..... 242/564.5, 564.2, 242/564.1; 312/34.22

(56) References Cited

U.S. PATENT DOCUMENTS

| | | | | |
|---|---|---|---|---|
| 2,334,689 | * | 11/1943 | Wooster | 242/564.5 |
| 2,957,738 | * | 10/1960 | Marcuse | 242/564.5 |
| 3,294,460 | * | 12/1966 | Wooster et al. | 312/34.22 |
| 3,489,361 | * | 1/1970 | Marion et al. | 242/564.5 |
| 4,236,679 | * | 12/1980 | Jespersen | 312/34.22 |
| 5,400,982 | | 3/1995 | Collins | 242/560 |

* cited by examiner

*Primary Examiner*—John Q. Nguyen
(74) *Attorney, Agent, or Firm*—Michael, Best & Friedrich LLP

(57) ABSTRACT

A dispenser for dispensing material from the outer surface of a roll. The dispenser includes a cabinet, and a drive roller having an outer surface. The drive roller is rotatably mounted in the cabinet so that the outer surface of the roll rests directly on the outer surface of the drive roller.

17 Claims, 4 Drawing Sheets

DISPENSER FOR MULTIPLE ROLLS OF SHEET MATERIAL

RELATED APPLICATIONS

This application claims the benefit under 37 C.F.R. §119 of prior filed, co-pending Provisional Application No. 60/076,289, filed on Feb. 27, 1998.

BACKGROUND OF THE INVENTION

This invention relates to dispensers of multiple rolls of sheet material and, in one aspect, to dispensers for two rolls of paper towels.

Dispensers for rolls of flexible material, such as paper towel rolls, are well known. Paper towel dispensers are widely used in public lavatories to dispense paper toweling for users to dry their hands. A roll of paper towels typically is rotatably supported inside the dispenser cabinet and either a crank or lever is operated by the user to drive a feed mechanism for dispensing the paper toweling. The feed mechanism typically includes a drive roller rotated by a crank or lever and a idler or pressure roller. The paper toweling is fed through a nip between these two rollers and the pressure roller is spring loaded or otherwise biased toward engagement with the drive roller. The tension resulting from the gripping action applied to the paper toweling as it is rolled around the drive roller pulls on the paper toweling to rotate the paper roll so that the paper toweling can be unwound from the paper roll. This tension varies in part depending on the amount of anti-rotation friction applied by the roll support. Nevertheless, pulling paper off of a suspended roll requires a transfer of energy from the nip, through the bonded fibers of the paper, to the suspended roll. To prevent tearing, the paper toweling being dispensed must have a sufficient tensile strength to withstand the tension required for unwinding.

SUMMARY OF THE INVENTION

There is a trend toward using paper toweling having lower tensile strengths by virtue of being designed to be softer and/or more absorbent. Such paper toweling typically includes larger size and/or more air pockets or is otherwise designed to be less dense. Such toweling requires fewer fibers per square inch of material and is generally less costly to produce than conventional roll toweling. However, conventional dispensers cannot be used to dispense such softer or more absorbent paper toweling because the tension required to unwind the toweling from a roll can exceed the tensile strength of the toweling and cause tearing of the toweling.

Accordingly, the invention provides a dispenser for dispensing material from the outer surface of a roll. The dispenser includes a cabinet, and a drive roller having an outer surface and being rotatably mounted in the cabinet so that the outer surface of the roll rests directly on the outer surface of the drive roller. The dispenser also includes a pressure roller rotatably mounted in the cabinet so that the material passes between the drive roller and the pressure roller, and a drive mechanism connected to the drive roller. The cabinet includes support means inside the cabinet cooperating with the outer surface of the drive roller to define a trough for removably receiving the roll such that the roll is at least partially supported by the drive roller. The dispenser also includes a support for supporting the roll so that the outer surface of the roll engages the outer surface of the drive roller.

It is a principal advantage of the invention to provide a dispenser for rolled toweling or other sheet material wherein the weight of the roll of toweling is supported directly on the drive roller so that the toweling is unwound from the roll directly onto the drive roller.

It is another advantage of the invention to provide a dispenser that eliminates the possibility of the roll "jumping" off of the support if the speed of the drive roller rapidly increases.

It is another advantage of the invention to provide a dispenser which is capable of dispensing sheet materials having low tensile strengths, such as softer or more absorbent paper toweling.

It is another advantage of the invention to provide a low cost dispenser for multiple rolls of sheet material including a minimum number of parts requiring separate fabrication and/or assembly.

It is another advantage of the invention to provide a dispenser that does not include a separate support for the reserve roll and/or the primary roll, and that can be used for dispensing core-less rolled sheet material.

Other features and advantages of the invention will become apparent to those skilled in the art upon reviewing the following detailed description, the drawing and the appended claim.

DETAILED DESCRIPTION

Figure 1:
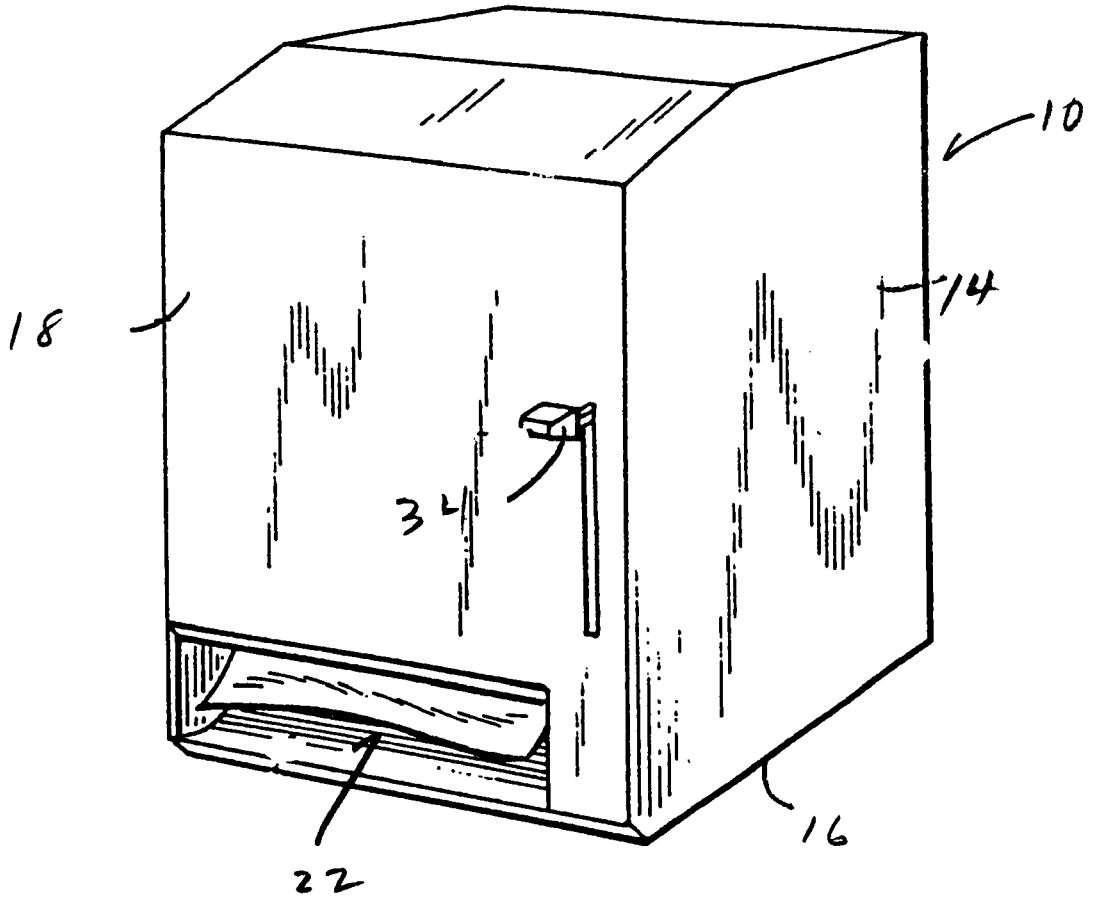
FIG. 1 is a perspective view of a paper towel dispensing cabinet embodying the invention and employing an operating lever for dispensing toweling.

While the dispensing device provided by the invention can be adapted to dispense a variety of wound flexible sheet materials, it is particularly adaptable for dispensing paper towel rolls and will be described in connection with that application.

Illustrated in the drawings is a two-roll paper towel dispensing cabinet 10 having a back wall 12, opposed side walls 14, a bottom wall 16 and a cover 18 which cooperate to define a storage compartment 20 for a stub or primary roll P and a main or reserve roll R of paper toweling. The cover 18 is pivotally mounted on the cabinet side walls 14 by hinges or the like and can be swung downwardly to an open position to gain access to the storage compartment 20 and swung upwardly to a closed position and locked in place with a suitable lock (not shown).

Paper toweling is dispensed from the cabinet 10 through a dispensing passage or opening 22 defined between the cutting edge of a cutoff member or blade 24 extending transversely relative to the cabinet side walls 14. The cutoff blade can be metal or formed as one edge of the opening 22 and the cutting edge has serrations or teeth so that the paper toweling extending through the dispensing opening 22 can be severed by pulling upwardly.

The feed mechanism for dispensing toweling from the cabinet 10 includes a drive roller 26 and an idler or pressure roller 28 which cooperate to form a pressure nip 30 through which the paper toweling is drawn before being dispensed from the cabinet 10. The drive roller 26 and the pressure roller 28 extend transversely with respect to and are supported from the cabinet side walls 14 for rotation about respective axes 27 and 29 which are parallel to each other and generally parallel to the rotational axes of the primary towel roll P and the reserve towel roll R 31 and 32, respectively. The opposite ends of the drive roller 26 are journalled in a suitable manner so that the rotational axis 27 is fixed. The opposite ends of the pressure roller 28 are mounted so that the rotational axis 29 is moved toward and away from the rotational axis 27 of the drive roller 26 and is spring loaded in a conventional manner so that it is urged into engagement with the drive roller 26 in a usual manner.

The drive roller 26 is rotated by a conventional lever assembly including a drive gear (not shown) connected to one end of the drive roller 26 via a one-way clutch (not shown) and a pivotally mounted operating lever 34 including a planetary gear segment (not shown) which meshes with the drive gear. Downward movement of the operating lever 34 rotates the drive roller in a clockwise direction as viewed in FIG. 2 to dispense a predetermined length of paper toweling.

Figure 2:
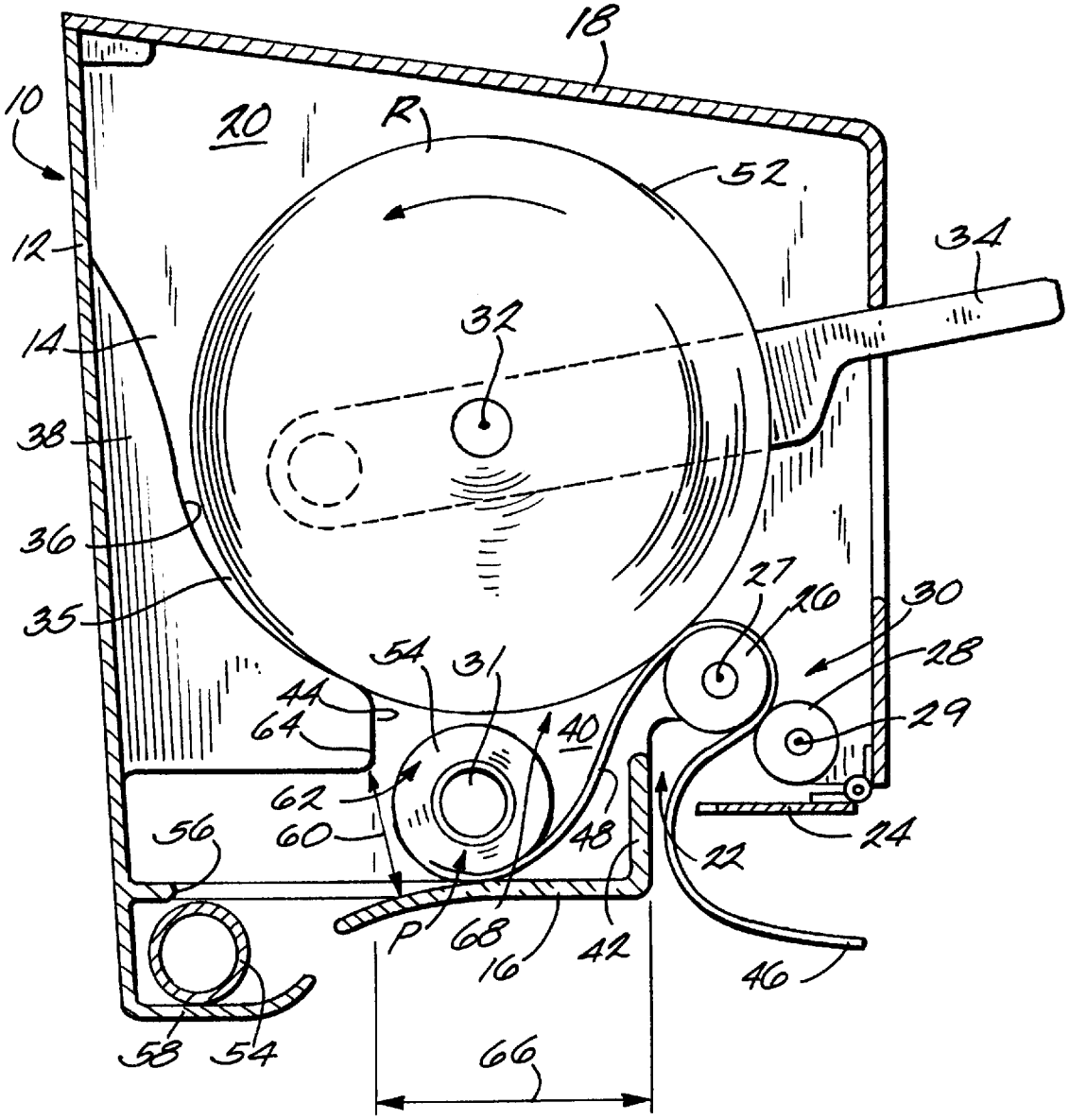
FIG. 2 is a partial cross sectional, side elevational view of the dispensing cabinet showing toweling being dispensed from a partially depleted primary roll.

The dispenser does not include a hanger or the like for supporting the reserve roll R above the drive roller 26. Rather, the cabinet 10 includes means for supporting the reserve roll R so that the reserve roll R is, at least in part, resting on the drive roller 26. More specifically, the reserve roll R "rides" in a trough 35 defined between the outer surface of the drive roller 26 and the arcuate front edges 36 of a plurality of laterally spaced ribs or ramps 38 extending inwardly from the cabinet back wall 12 as illustrated in FIG. 2. The force of gravity on the roll R pushes the roll R downward against the front edges 36 of ramps 38. These, in turn, bias the roll R forward so that the outer surface of the roll R rests directly on the outer surface of the drive roller 26. When the cabinet 10 is molded from a synthetic plastic material in accordance with a preferred embodiment, the ramps 38 can be molded as an integral part of the back wall 12 or designed to be snap fitted into the back wall 12. This construction eliminates many parts normally required in conventional towel dispensers thereby reducing the cost and complexity of the product and improving the reliability of the product. Moreover, rather than the discrete ribs or ramps, the rear sidewall 12 could simply be molded so as to ramp inwardly thereby biasing the roll R toward the drive roller 26.

A partially depleted primary roll P sits in a pocket 40 defined by the cabinet bottom wall 16, a partition 42 extending upwardly from the cabinet bottom wall 16 and a front-most portion 44 of the ramps 38. As with the ramps 38, the partition 42 can be formed as an integral part of the cabinet bottom wall 16 or to be snap fitted onto the cabinet bottom wall 16.

FIG. 2 illustrates the positions of the reserve roll R and the primary roll P when paper toweling 46 is being dispensed from a partially depleted primary roll P with a new reserve roll R in place. When in this mode, the leading end 46 of the paper toweling 48 from the primary roll P extends over the drive roller 26 and between the drive roller 26 and the pressure roller 28. Downward movement of the operating lever 34 causes the paper toweling 46 to be unwound from the bottom of the primary roll P. The leading end of the paper toweling 52 on the reserve roll R remains attached to the roll as it rotates in response to rotation of the drive roller 26 as described below.

The outer surface of the reserve roll R is biased by gravity against the front edges 36 of the ramps 38 and the outer surface of the drive roller 26 or, if paper toweling 46 is being dispensed from the primary roll P, against the surface of the paper toweling 48 from the primary roll extending over the drive roller 26. FIG. 2 shows a space between the outer surface of the reserve roll R and the front edges 36 of the ramps for sake of clarity. In actual practice, the outer surface of reserve roll R slidably engages the front edges 36 of the ramps 38. The reserve roll R "rides" in the trough 35 so it can be rotated counterclockwise, as viewed in FIG. 2, when the drive roller 26 is rotated clockwise by downward movement of the operating lever 34. The outer surface of the reserve roll R rolls against the paper toweling 46 from the primary roll P when paper toweling is being dispensed from the primary roll P or against the outer surface of the drive roller 26 when paper toweling is being dispensed only from the reserve roll R.

The gravity-based engagement of the reserve roll R with the drive roller 26 and the ramps 38 restricts the reserve roll R from free wheeling when the operating lever 34 is moved downwardly. Since the paper toweling 48 is unwound from the bottom of the reserve roll R (instead of from the top like in most conventional dispensers) and the reserve roll R is in rolling engagement with the drive roller 26, rotation of the drive roller 26 rotates the reserve roll R to unwind the paper toweling 48 therefrom without the need for appreciable pulling on the paper toweling 48 (as is the case with most conventional dispensers). Thus, the dispenser of the invention functions as a surface unwinder, thereby permitting lower tensile strength paper toweling can be dispensed without tearing.

When a service person opens the cabinet 10 to ascertain the amount of paper toweling remaining on the primary roll P and notes that the primary roll P has been or shortly will be depleted, he or she grabs the leading end of the paper toweling 52 on the reserve roll R, detaches it from the roll and stuffs it into the nip 30 between the drive roller 26 and the pressure roller 28. The pressure roller 28 preferably has two or more laterally spaced, circumferentially extending grooves (not shown) into which the leading end of the paper toweling 52 from the reserve roll R can be stuffed to facilitate initial feeding between the primary roll P and the reserve roll R. The reserve roll R must be placed in the trough so that, during subsequent downward movement of the operating lever 32, the paper toweling 52 is unrolled from the bottom of the reserve roll R. The paper toweling 46 remaining on the primary roll P, if any, will continue to be dispensed along with that from the reserve roll R until the primary roll P has been depleted.

Since there is no holder for either the primary roll P or reserve roll R, the dispenser can be used to dispense both paper towel rolls including a core and core-less rolls without any modifications or installation of any additional parts. In the specific embodiment illustrated in FIG. 2, the cabinet 10 is arranged to let a service person know when a primary roll P including a core 54 has been depleted. The cabinet bottom wall 16 includes a transversely extending, elongated slot 56 through which an empty or nearly empty core 54 can drop into a catch mechanism 58. A portion of the cabinet bottom wall 16 defining the pocket 40 can be slanted to urge an empty core 54 towards the slot 56. The width 60 of the opening 62 between the cabinet bottom wall 16 and a lower part 64 of the ramps 68 is sized to retain the primary roll P in the pocket 40 until the core 54 is empty or at least almost empty.

Figure 5:
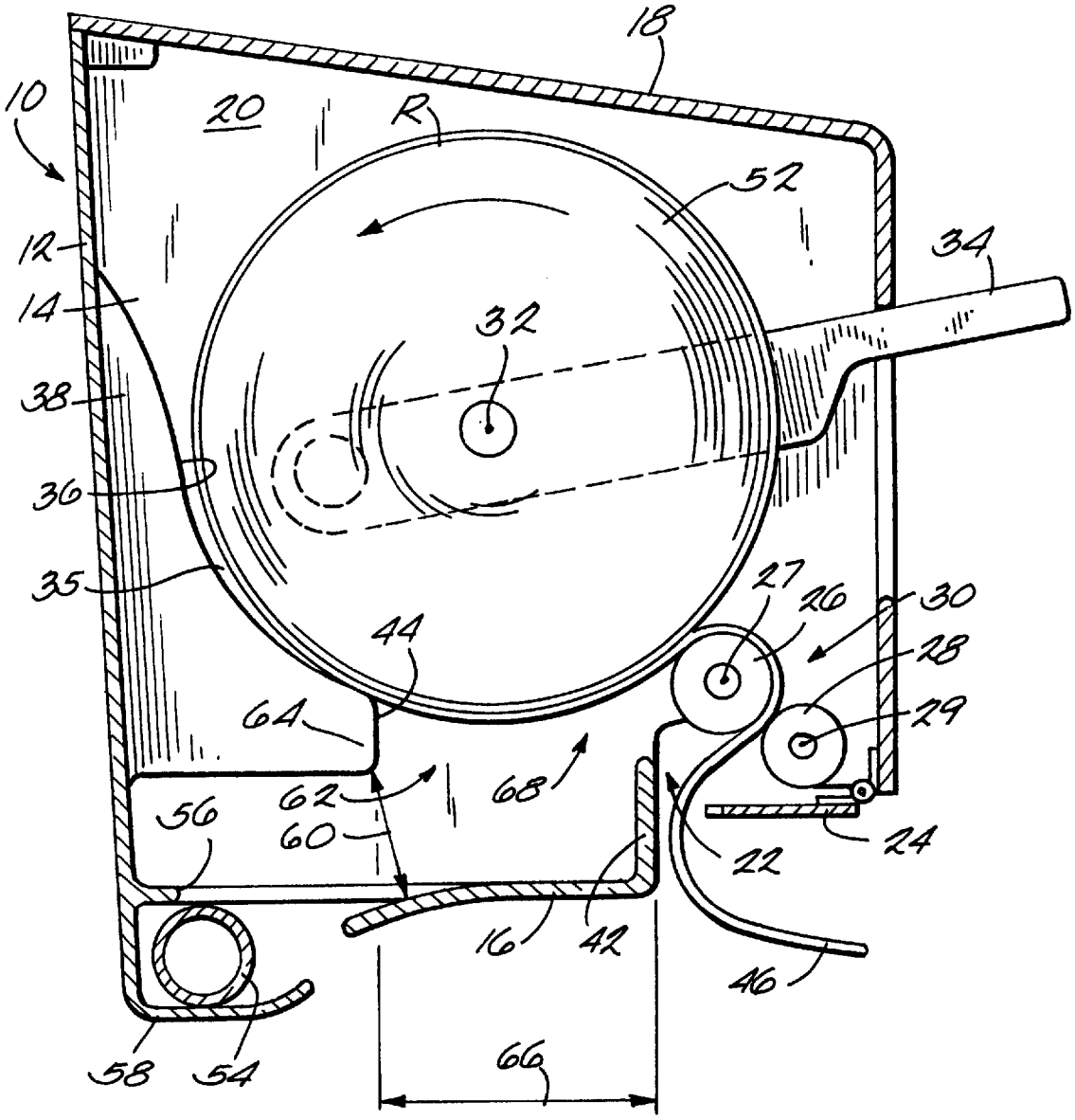
FIG. 5 is a view similar to FIG. 2 showing toweling being dispensed from a new roll.

As shown in FIG. 5, initially, only the reserve roll R in the cabinet 10 is in use. Accordingly, the paper toweling 46 is unwound directly from the surface of the reserve roll R onto the surface of the drive roller 26. In other embodiments (not shown), the space 40 for holding the primary roll P is eliminated and the primary roll in always positioned in the trough 35. In still other embodiments (not shown), a coreless paper towel roll is used so that, when the sheet material is gone, there is no empty core 54 for service personnel to discard.

When a service person notices an empty core 54 in the catch arrangement 58, he or she knows that the cabinet 10 should be opened to determine how much paper toweling is left on the reserve roll R. The width 66 of the opening 68 in the bottom of the trough 34, i.e., the transversely extending opening between the front-most portions 44 of the ramps 38 and the outer surface of the drive roller 26, is sized to retain the reserve roll R in the trough 34 until the outside diameter of the reserve roll R corresponds to a predetermined amount of paper toweling having been dispensed from the reserve roll R. The partially depleted reserve roll R then drops into the pocket 40 and becomes the primary roll P.

When a service person opens the cabinet and notices that the reserve roll R has dropped into the pocket 40, a new reserve roll is placed into the trough 40 and oriented so that paper toweling will unwind from the bottom of the roll. If the primary roll P is depleted or close to being depleted, the service person can stuff the leading end of the paper toweling 52 of the reserve roll R into the nip 30 between the drive roller 26 and the pressure roller 28 and operate the operating lever 34 until paper toweling 52 from the reserve roll R is being dispensed through the dispensing opening 22. If the primary roll P is not close to being depleted, the service person later makes a periodic inspection(s) to check the status of the primary roll P and waits until the primary roll P is depleted or close to being depleted before starting dispensing from the reserve roll R as described above.

Figure 3:
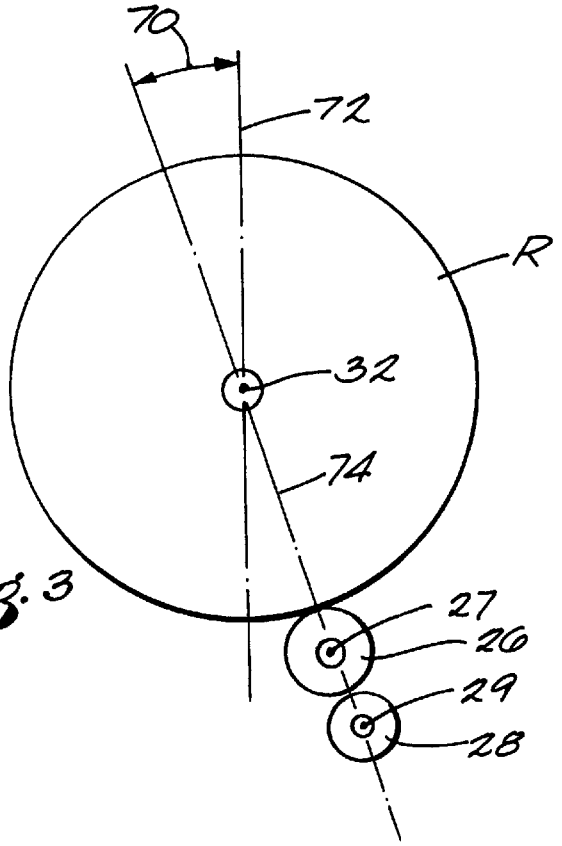
FIG. 3 is a schematic representation of an undesirable operational angular relationship between the rotational axis of the reserve roll and the drive roller.
Figure 4:
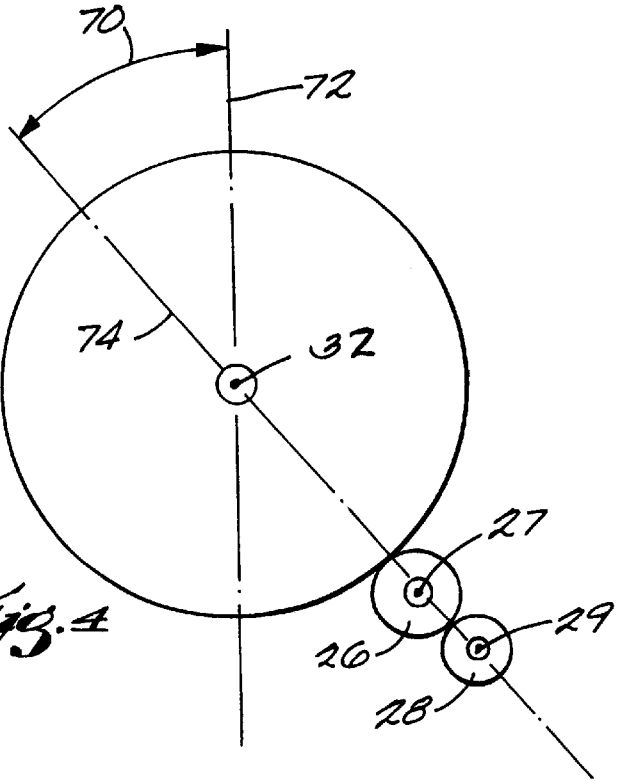
FIG. 4 is a schematic representation of a desirable operational angle for the reserve roll and the drive roller.

Since the reserve roll R is free to move within the trough 35, if not properly positioned, it could tip over the drive roller 26, as illustrated in FIG. 3, and cause erratic or no dispensing. To prevent such a tip over from occurring, the trough 35 is arranged (as shown in FIG. 4), to provide an operational angle 70 between a vertical plane 72 intersecting the rotational axis 31 of the reserve roll R and plane 74 intersecting the rotational axis 27 of the drive roller 26 which results in the reserve roll R being gravity biased downwardly toward the front edges 36 of the ramps 38.

From the foregoing description, it can be seen that the dispenser provided by the invention is simply constructed and can be made from an inexpensive, and yet durable, materials for economical manufacture and assembly. It can dispense lower tensile strength paper toweling and other sheet materials without tearing. It does not require separate supports for the primary roll P or the reserve roll R and can dispense paper toweling and other sheet materials with or without a core without having to make any modifications or install any additional parts.

Various features and advantages of the invention are set forth in the following claims.

What is claimed is:

1. A dispenser for dispensing material from the outer surface of a roll having a diameter, the dispenser comprising:

a cabinet;

a trough inside the cabinet for supporting the roll, the trough being defined by a ramp having a front edge and a front-most portion, and a drive roller rotatably mounted in the cabinet and having an outer surface, the front-most portion and the outer surface defining a linear dimension therebetween so that when the diameter is greater than the linear dimension, the outer surface of the roll rests in the trough, directly on the outer surface of the drive roller and on the front edge of the ramp; and a pocket below the trough so that the roll automatically drops into the pocket between the front-most portion of the ramp and the outer surface of the drive roll when the diameter is less than the linear dimension;

wherein material can be dispensed from the outer surface of the roll when the roll is supported in the trough and when the roll is in the pocket.

2. A dispenser as set forth in claim 1, further comprising a pressure roller rotatably mounted in the cabinet so that the material passes between the drive roller and the pressure roller.

3. A dispenser as set forth in claim 1, wherein the roll is gravity-biased toward the ramp to prevent the roll from being pulled over the drive roller.

4. A dispenser as set forth in claim 1, wherein the pocket includes a bottom wall for supporting the roll in the pocket.

5. A dispenser as set forth in claim 4, wherein the pocket includes a partition wall extending upwardly from the bottom wall.

6. A dispenser as set forth in claim 4, further including a catch mechanism beneath the bottom wall, the catch mechanism communicating with the pocket via a slot in the bottom wall.

7. A dispenser as set forth in claim 6, wherein a portion of the bottom wall is slanted toward the slot to urge the roll toward the slot and into the catch mechanism.

8. A dispenser for dispensing material from the outer surface of a roll having a diameter, the dispenser comprising:

a cabinet;

a trough within the cabinet for supporting the roll, the trough being defined by a support ramp having a front edge and a front-most portion, and a drive roller rotatably mounted in the cabinet and having an outer surface, the front-most portion and the outer surface defining therebetween an opening in the trough; and a pocket below the opening and having a bottom wall for supporting the roll in the pocket when the roll automatically drops into the pocket through the opening;

wherein the roll automatically drops into the pocket after a sufficient amount of material is dispensed from the outer surface of the roll while the roll is supported in the trough; and wherein material continues being dispensed from the outer surface of the roll after the roll drops into the pocket.

9. A dispenser as set forth in claim 8, further comprising a pressure roller rotatably mounted in the cabinet so that the material passes between the drive roller and the pressure roller.

10. A dispenser as set forth in claim 8, wherein the roll is gravity-biased toward the support ramp to prevent the roll from being pulled over the drive roller.

11. A dispenser as set forth in claim 8, wherein the pocket includes a partition wall extending upwardly from the bottom wall.

12. A dispenser as set forth in claim 8, further including a catch mechanism beneath the bottom wall, the catch mechanism communicating with the pocket via a slot in the bottom wall.

13. A dispenser as set forth in claim 12, wherein a portion of the bottom wall is slanted toward the slot to urge the roll toward the slot and into the catch mechanism.

14. A dispenser for dispensing material from the outer surface of a roll having a diameter, the dispenser comprising:

a cabinet;

a trough inside the cabinet for supporting the roll, the trough being defined by a ramp having a front edge and a front-most portion, and a drive roller having an outer surface, wherein the front-most portion and the outer surface define a linear dimension therebetween so that when the diameter is greater than the linear dimension, the outer surface of the roll rests in the trough, directly on the outer surface of the drive roller and on the front edge of the ramp;

a pocket below the trough and having a bottom wall for supporting the roll in the pocket when the diameter is less than the linear dimension and the roll automatically drops into the pocket; and a pressure roller rotatably mounted in the cabinet such that the material passes between the drive roller and the pressure roller to be dispensed from the outer surface of the roll both when the roll is supported in the trough and when the roll is supported in the pocket.

15. A dispenser as set forth in claim 14, wherein the pocket includes a partition wall extending upwardly from the bottom wall.

16. A dispenser as set forth in claim 14, further including a catch mechanism beneath the bottom wall, the catch mechanism communicating with the pocket via a slot in the bottom wall.

17. A dispenser as set forth in claim 16, wherein a portion of the bottom wall is slanted toward the slot to urge the roll toward the slot and into the catch mechanism.

* * * * *